US008570002B2

(12) United States Patent
Burnham et al.

(10) Patent No.: US 8,570,002 B2
(45) Date of Patent: Oct. 29, 2013

(54) START/STOP OPERATION FOR A CONTAINER GENERATOR SET

(75) Inventors: Randy S. Burnham, Maple Grove, MN (US); David J. Renken, Prior Lake, MN (US)

(73) Assignee: Thermo King Corporation, Minneapolis, MN (US)

( * ) Notice: Subject to any disclaimer, the term of this patent is extended or adjusted under 35 U.S.C. 154(b) by 39 days.

(21) Appl. No.: 13/452,007

(22) Filed: Apr. 20, 2012

(65) Prior Publication Data

US 2012/0202414 A1 Aug. 9, 2012

Related U.S. Application Data

(62) Division of application No. 12/471,539, filed on May 26, 2009, now Pat. No. 8,185,251.

(60) Provisional application No. 61/056,604, filed on May 28, 2008.

(51) Int. Cl.

| | |
|---|---|
| ***H02P 7/06*** | (2006.01) |
| ***H02P 9/00*** | (2006.01) |
| *G05D 23/00* | (2006.01) |
| *F25B 1/10* | (2006.01) |
| *F25D 3/10* | (2006.01) |
| *F02D 25/00* | (2006.01) |

(52) U.S. Cl.
USPC ..... 322/17; 700/299; 700/300; 62/510; 62/529; 290/40 C

(58) Field of Classification Search
USPC ..... 700/299–300; 62/510, 529; 322/17; 454/118; 290/40 C
See application file for complete search history.

(56) References Cited

U.S. PATENT DOCUMENTS

| | | | | | |
|---|---|---|---|---|---|
| 2,696,086 | A | * | 12/1954 | Jones | 62/65 |
| 3,100,384 | A | * | 8/1963 | Lowensohn | 165/202 |
| 3,646,773 | A | * | 3/1972 | Falk et al. | 62/160 |
| 3,983,715 | A | * | 10/1976 | Hair et al. | 62/243 |
| 4,878,465 | A | | 11/1989 | Hanson et al. | |
| 4,903,498 | A | | 2/1990 | Hanson | |
| 4,903,502 | A | | 2/1990 | Hanson et al. | |
| 4,949,550 | A | | 8/1990 | Hanson | |
| 5,050,402 | A | | 9/1991 | Graaff | |
| 5,187,945 | A | | 2/1993 | Dixon | |
| 5,401,589 | A | * | 3/1995 | Palmer et al. | 429/408 |
| 5,561,330 | A | | 10/1996 | Crook | |
| 5,977,646 | A | | 11/1999 | Lenz et al. | |
| 6,095,427 | A | | 8/2000 | Hoium et al. | |
| 6,107,927 | A | | 8/2000 | Dvorsky et al. | |

(Continued)

FOREIGN PATENT DOCUMENTS

| | | |
|---|---|---|
| DE | 10143526 | 4/2003 |
| EP | 0355946 | 2/1990 |

(Continued)

*Primary Examiner* — Ramesh Patel
(74) *Attorney, Agent, or Firm* — Michael Best & Friedrich LLP

(57) ABSTRACT

A generator set including a prime mover, a generator coupled to the prime mover, and a controller that is associated with a temperature controlled space and operates the generator set in one of a start/stop mode and a continuous mode depending on a demand defined at least in part by contents within the temperature controlled space.

8 Claims, 2 Drawing Sheets

(56) References Cited

U.S. PATENT DOCUMENTS

| | | | | |
|---|---|---|---|---|
| 6,138,580 | A | 10/2000 | Thoman | |
| 6,543,245 | B1 | 4/2003 | Waldschmidt et al. | |
| 6,622,505 | B2 | 9/2003 | Anderson et al. | |
| 6,792,772 | B1 | 9/2004 | Seiss et al. | |
| 6,829,523 | B2 | 12/2004 | Hanson | |
| 6,895,764 | B2 | 5/2005 | Viegas et al. | |
| 7,043,932 | B2 | 5/2006 | Tofflemire | |
| 7,263,855 | B2 | 9/2007 | Meyer et al. | |
| 7,614,242 | B1 | 11/2009 | Quesada Saborio | |
| 7,743,616 | B2 * | 6/2010 | Renken et al. | 62/134 |
| 7,765,831 | B2 | 8/2010 | Rodriguez et al. | |
| 7,913,511 | B2 | 3/2011 | Meyer et al. | |
| 2004/0226309 | A1 | 11/2004 | Broussard | |
| 2006/0186669 | A1 * | 8/2006 | Ruggieri et al. | 290/2 |
| 2007/0074528 | A1 | 4/2007 | Rodriguez et al. | |
| 2007/0101989 | A1 * | 5/2007 | Strathman | 126/636 |
| 2007/0251685 | A1 | 11/2007 | Viegas | |
| 2007/0296379 | A1 | 12/2007 | Gendron | |
| 2008/0087029 | A1 * | 4/2008 | Renken et al. | 62/134 |
| 2011/0036091 | A1 * | 2/2011 | Waterstripe et al. | 60/643 |
| 2011/0247350 | A1 * | 10/2011 | Awwad et al. | 62/115 |
| 2012/0160446 | A1 * | 6/2012 | Creed et al. | 165/41 |

FOREIGN PATENT DOCUMENTS

| | | |
|---|---|---|
| GB | 2098362 | 11/1982 |
| JP | 3181766 | 8/1991 |
| JP | 5034060 | 2/1993 |
| JP | 5038933 | 2/1993 |
| JP | 6109333 | 4/1994 |
| JP | 6109352 | 4/1994 |

* cited by examiner

START/STOP OPERATION FOR A CONTAINER GENERATOR SET

RELATED APPLICATIONS

This patent application is a divisional application of U.S. patent application Ser. No. 12/471,539 filed May 26, 2009 and claims priority to U.S. Provisional Patent Application No. 61/056,604 filed May 28, 2008; the contents of all documents identified above are incorporated by reference in their entirety herein.

BACKGROUND

The invention relates to temperature controlled shipping containers. More specifically, the invention relates to electrical power generation for an air-conditioning system of a temperature controlled shipping container.

Containerized shipment of goods has become a widely accepted means of transporting cargo around the world. Modern containers can be stacked on the decks of ships for shipment overseas. When a container ship arrives at a port, the containers can be efficiently removed from the ship by crane. At the port, the containers can be stacked for further shipment by truck or rail. When the containers are shipped by truck, a single container is usually placed on a semi-trailer chassis. Each rail car generally can support up to four containers.

When the cargo in the container is comprised of perishables such as food stuffs or flowers, the temperature in each of the containers must be controlled to prevent loss of the cargo during shipment. For shipments of perishable goods, specialized containers have been developed which include temperature control units for refrigeration and/or heating. While on board ship, the containers can be connected to a ship's generator to provide power to the temperature control units. When the containers are in port, they may be connected to a power source provided by a local utility.

When, however, the containers are not provided with an external power source, generator sets must be provided to power the temperature control units. For example, when the containers are in transit by railcar, barge, or truck, generator sets may be necessary. Such generator sets usually include a diesel engine to power a generator which in turn provides electric power to the temperature control units. Such generator sets can be clipped directly to a container or fastened to a trailer chassis.

During shipment, the temperature control units and generator sets must operate for extended periods of time. For example, when lettuce is shipped from California to the northeastern United States, the sets may run periodically for several days. During this extended period of time, the temperature control unit and generator set will operate for extended periods of time without inspection by transportation workers. This is particularly true in the case of rail transportation where scores of railcars may, for extended periods of time, be in transport while accompanied by only two or three transportation workers.

SUMMARY

In one embodiment, the invention provides a generator set for a container having an air-conditioning unit for controlling the temperature of a space within the container. The generator set includes a prime mover, a generator coupled to the prime mover, and a controller that operates the prime mover in one of a start/stop mode wherein the controller selectively starts and stops operation of the prime mover, and a continuous mode wherein the controller runs the prime mover continuously. When the controller operates the prime mover in the start/stop mode, the controller automatically starts and stops the prime mover such that the generator produces electricity and is operable to supply the electricity to the air-conditioning unit when the prime mover is operating and the generator does not produce electricity when the prime mover is not operating. The controller is operable to start and stop the prime mover based on a cooling demand.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
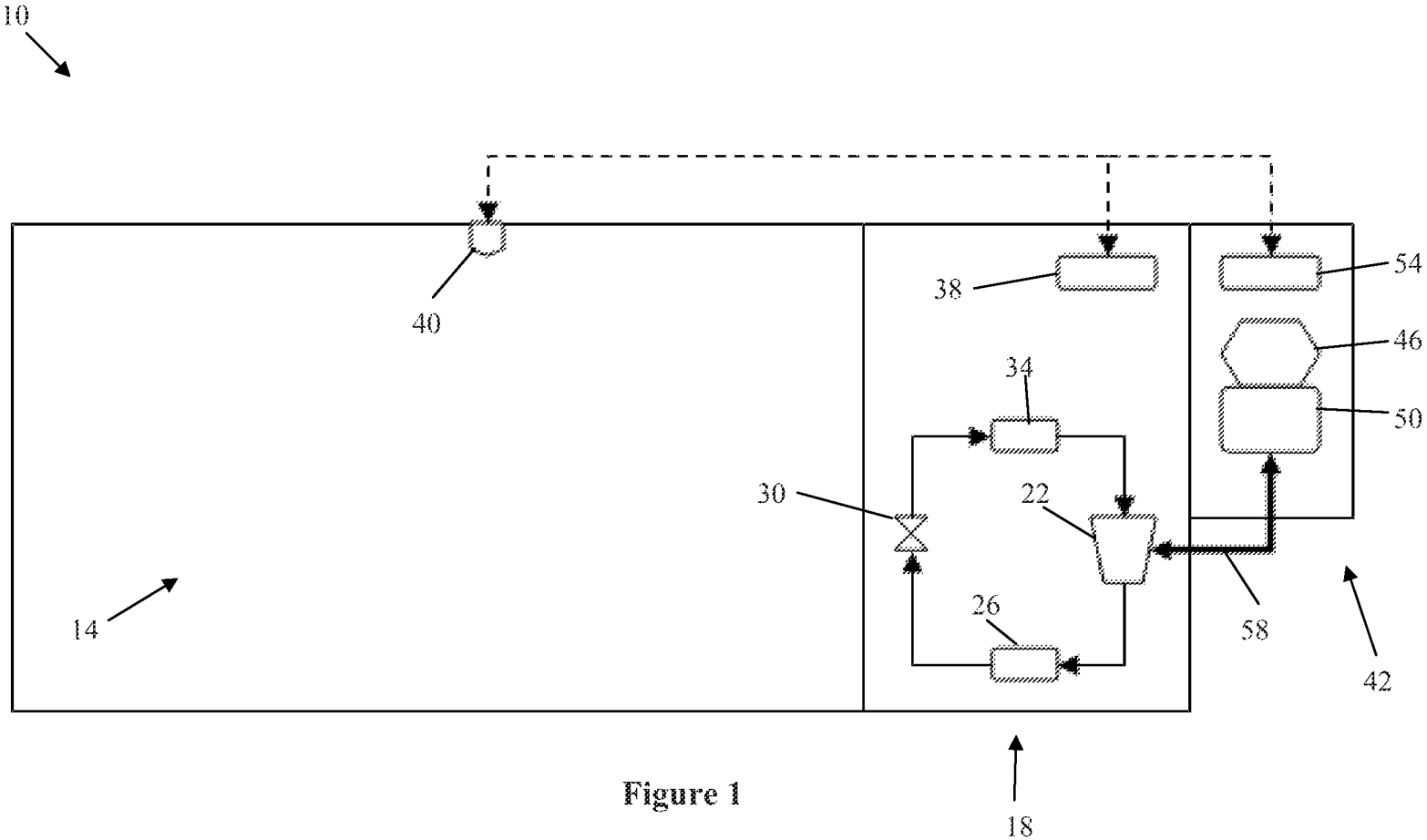
FIG. 1 is a schematic representation of a temperature controlled shipping container.

FIG. 1 shows a shipping container 10 that defines a temperature controlled space 14. Typical shipping containers are constructed from steel and include four side walls and a closed top and bottom. One of the side walls generally includes a door or set of doors that allow selective access to the temperature controlled space 14. In the illustrated embodiment, the shipping container is a temperature controlled shipping container and includes an insulated layer that inhibits heat transfer from the temperature controlled space 14 to the ambient environment. In other embodiments, the shipping container 10 may not have an insulated layer, may have more or less doors, or may have other features, as desired.

A refrigeration unit 18 is coupled to the shipping container 10 and provides conditioned air to the temperature controlled space 14. The illustrated refrigeration unit 18 is formed as a part of the shipping container 10 and is a refrigeration system that cools air and includes an electric compressor 22, a condenser 26, an expansion valve 30, an evaporator 34, and a refrigeration controller 38. The refrigeration unit 18 conditions the air within the temperature controlled space 14 to a desired condition. For example, a set-point temperature may be selected by a user and programmed into the refrigeration controller 38 such that the refrigeration unit 18 will operate to maintain the temperature within the temperature controlled space 14 at the setpoint temperature. In other embodiments, the refrigeration unit 18 may include a heating system, an air-filtration system, a spray system for ripening agents or other products, or other components, as desired.

The illustrated refrigeration controller 38 communicates with a sensor 40 positioned within the temperature controlled space 14, and operates the refrigeration unit 18 to maintain the desired condition. Many operational modes may be used to control the refrigeration unit 18 including start/stop and continuous operational modes. The illustrated sensor 40 is a temperature sensor that returns a signal indicative of the temperature within the temperature controlled space 14. In other embodiments, more than one sensor 14 may be positioned throughout the temperature controlled space 14. In addition, other sensors or systems may communicate with the refrigeration controller 38, as desired.

A generator set 42 is coupled to the shipping container 10 and includes a prime mover 46, a generator 50, and a generator controller 54. The generator set 42 powers the refrigeration unit 18 via connection 58, which in the illustrated embodiment is a power cable. The illustrated generator set 42 is removably attached to the shipping container 10 such that the generator set 42 may be attached to the shipping container 10 when required (e.g., during transit on a train), and removed when the generator set 42 is not required (e.g., when being stored in a location where external power is available). For example, while a shipping container 10 is being stored at a shipping dock external power lines may be available to power the refrigeration unit 18 such that the generator set 42 is not necessary. While in transit, for example on a rail or train, the generator set 42 may be required to power the refrigeration unit 18.

The illustrated prime mover 46 is a diesel engine that includes an automatic starter and drives the generator 50. With respect to this application, a generator is any electric machine that converts mechanical energy into electric energy. The illustrated generator 50 is an AC generator that produces a 50 hertz or 60 hertz alternating current output while the prime mover 46 is running. The generator 50 supplies electricity to the refrigeration unit 18 and any other systems that may be included in the shipping container 10.

The illustrated generator controller 54 communicates with the refrigeration controller 38 and the sensor 40 via power-line transmission, data cables, or another communication medium, to control the generator set 42. In addition, to integrate the illustrated generator controller 54 and associated control system, no additional components or add-on hardware is necessary. In other embodiments, the generator controller 54 may communicate with other sensors or systems. In addition, the generator controller 54 may not communicate with the refrigeration controller 38 but may instead communicate directly with the sensor 40 to control the generator set 42. In still other embodiments, the generator controller 54 may not communicate with any sensors, but rather communicate only with the refrigeration controller 38.

Figure 2:
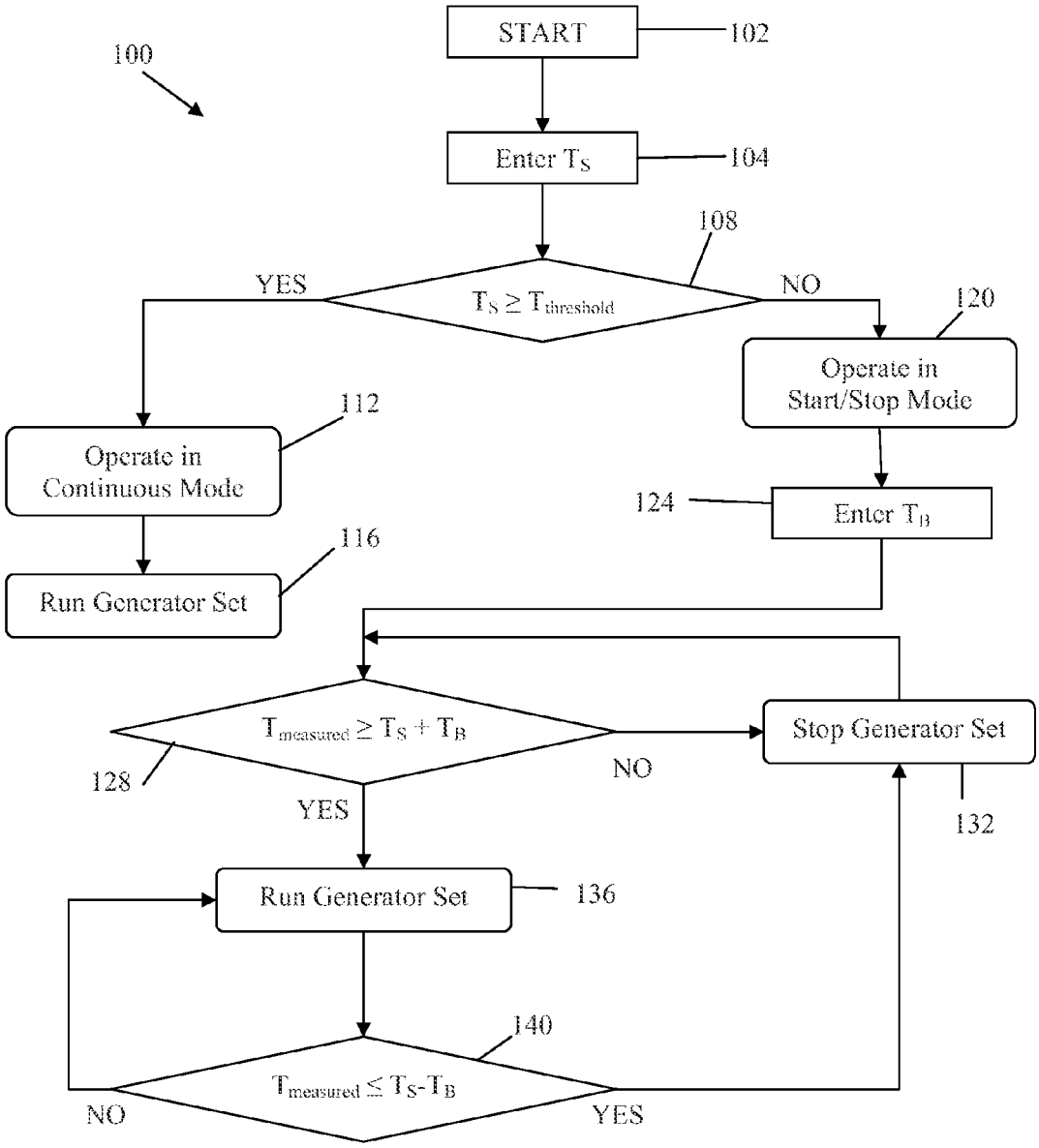
FIG. 2 is a flow chart that illustrates the method of operating the temperature controlled shipping container of FIG. 1.

In operation, the refrigeration controller 38 executes a method 100 shown in FIG. 2, during which the refrigeration unit 18 and refrigeration controller 38 operate to maintain the desired condition within the temperature controlled space 14 while powered by an external power line or the generator set 42. The method 100 is described in reference to a situation requiring cooling of the shipping container 10 in higher ambient temperatures. FIG. 2 refers to a situation where the generator set 42 is powering the refrigeration unit 18. When the shipping container 10 is fit with the generator set 42 and the system is started at block 100, a user enters a temperature setpoint $T_S$ at block 104 into the refrigeration controller 38. The temperature setpoint $T_S$ is selected based on the product to be shipped within the temperature controlled space 14 of the shipping container 10. Often, temperatures above thirty degrees Fahrenheit are considered to be within the fresh range and temperatures below thirty degrees Fahrenheit are considered to be within the frozen range.

After block 104, the refrigeration controller 38 compares the temperature setpoint $T_S$ to a threshold temperature $T_{threshold}$ at block 108. The threshold temperature $T_{threshold}$ may be predetermined by the owner of the unit, selected by a user, set by the manufacturer, or set in another way. Often, the threshold temperature $T_{threshold}$ is the temperature between the fresh and frozen ranges (e.g., thirty degrees Fahrenheit), although the threshold temperature could be any other suitable temperature value. For example, the threshold temperature $T_{threshold}$ may be an upper or lower ambient temperature, or another temperature value, as desired. If the refrigeration controller 38 determines that the setpoint temperature $T_S$ is above the threshold temperature $T_{threshold}$, then the refrigeration controller 38 operates the refrigeration unit 18 and the generator set 42 in the continuous mode at block 112. While the refrigeration unit 18 is running in continuous mode, the generator set 42 runs constantly at block 116 to supply power to the refrigeration unit 18.

If the refrigeration controller 38 determines that the setpoint temperature $T_S$ is less than the threshold temperature $T_{threshold}$ at block 108, the refrigeration controller 38 operates the refrigeration unit 18 and the generator set 42 in the start/stop mode at block 120. In the start/stop mode, the refrigeration controller 38 cycles the generator set 42 on and off such that the refrigeration unit 18 provides conditioned air to the temperature controlled space 14 while the generator set 42 is running, and does not provide conditioned air to the temperature controlled space 14 while the generator set 42 is not running.

At block 124 the refrigeration controller 38 receives a temperature bandwidth $T_B$ that represents the upper and lower temperature limits of the temperature controlled space 14 with respect to the setpoint temperature $T_S$. For example, if the setpoint temperature $T_S$ is zero degrees Fahrenheit and the temperature bandwidth $T_B$ is ten degrees Fahrenheit, then the potential temperature range of the temperature controller space would be negative ten degrees Fahrenheit to positive ten degrees Fahrenheit. The temperature bandwidth $T_B$ may be entered by the user into the refrigeration controller 38, predetermined by the owner of the shipping container 10, selected by the manufacturer, or set in another way, as desired.

After the refrigeration controller 38 begins operation in the start/stop mode at block 120, the refrigeration controller 38 monitors a measured temperature $T_{measured}$ with the sensor 40, and compares it to the setpoint temperature $T_S$ and the temperature bandwidth $T_B$ at block 128. In the illustrated example, if the measured temperature $T_{measured}$ is less than the sum of the setpoint temperature $T_S$ and the temperature bandwidth $T_B$, then the refrigeration controller 38 at block 128 determines a NO and the generator set 42 is stopped at block 132, thereby stopping the refrigeration unit 18 such that no conditioned air is provided to the temperature controlled space 14. The refrigeration controller 38 continually cycles through blocks 128 and 132, such that the refrigeration controller 38 inhibits the generator set 42 from running while the measured temperature is not greater than the sum of the setpoint temperature $T_S$ and the temperature bandwidth $T_B$. While the generator set 42 is not running the measured temperature $T_{measured}$ within the temperature controlled space 14 will increase over time due to heat transfer through the walls of the shipping container 10. The insulation layer inhibits heat transfer through the walls, but over time the measured temperature $T_{measured}$ will rise.

When the refrigeration controller 38 determines that the measured temperature $T_{measured}$ is greater than the sum of the setpoint temperature $T_S$ and the temperature bandwidth $T_B$ at block 128 (YES), the refrigeration controller 38 starts the generator set 42 at block 136 and allows the generator set 42 to run such that the refrigeration unit 18 is powered and provides conditioned air to the temperature controlled space 14 to cool the space thereby decreasing the measured temperature $T_{measured}$.

While the generator set 42 and refrigeration unit 18 are running, the refrigeration controller 38 compares the measured temperature $T_{measured}$ to the setpoint temperature $T_S$ and the temperature bandwidth $T_B$ at block 140. If the measured temperature $T_{measured}$ is not less than or equal to the difference of the setpoint temperature $T_S$ and the temperature bandwidth $T_B$ (NO), then the refrigeration controller 38 continues to run the generator set 42, and the measured temperature $T_{measured}$ continues to decrease. The refrigeration controller 38 cycles through blocks 136 and 140 until the measured temperature $T_{measured}$ is less than or equal to the difference of the setpoint temperature $T_S$ and the temperature bandwidth $T_B$ (YES). Then, the refrigeration controller 38 stops generator set 42 at block 132 and the refrigeration controller 38 returns to block 128.

As described above with respect to the illustrated embodiment, the refrigeration controller 38 controls the refrigeration unit 18 and is in direct communication with the sensor 40. The refrigeration controller 38 receives the setpoint temperature $T_S$, recognizes the threshold temperature $T_{threshold}$, and makes the determination at block 108. The refrigeration controller 38 then runs the refrigeration unit 18 and generator set 42 in either continuous mode at block 112, or start/stop mode at block 120. If the method 100 is operating in the start/stop mode, then the refrigeration controller 38 makes the determination at block 128 and communicates with the generator controller 54 such that the generator controller 54 starts and stops the prime mover 46 as instructed by the refrigeration controller 38.

In another embodiment, the generator controller 54 is in direct communication with the sensor 40. The generator controller 54 receives the setpoint temperature $T_S$, recognizes the threshold temperature $T_{threshold}$, and makes the determination at block 108. The generator controller 54 then runs the refrigeration unit 18 and generator set 42 in either continuous mode at block 112, or start/stop mode at block 120. If the method 100 is operating in the start/stop mode, then the generator controller 54 makes the determination at block 128 and starts and stops the prime mover 46 according to the method 100. The generator controller 54 may additionally communicate with the refrigeration controller 38 to start and stop the refrigeration unit 18.

In yet another embodiment, the refrigeration controller 38 and the generator controller 54 may cooperate to utilize the method 100 such that the temperature within the temperature controlled space 14 (i.e., the measured temperature $T_{measured}$) is maintained at the setpoint temperature $T_S$.

In still another embodiment, the refrigeration controller 38 may be eliminated, or the generator controller 54 may not be able to communicate with the refrigeration controller 38. For example, if the generator set 42 and the refrigeration unit 18 are produced by separate manufacturers the controllers may not include compatible software, but the generator set 42 and the refrigeration unit 18 may physically operate together. In such an embodiment, the generator controller 54 is able to detect the power demand of the refrigeration unit 18. If the refrigeration unit 18 is demanding power, the generator set 42 recognizes the demand and starts such that the refrigeration unit 18 is powered and provides conditioned air to the temperature controlled space 14 to reduce the measured temperature $T_{measured}$. The generator set 42 then continues to monitor the power demand of the refrigeration unit 18 while running. If the refrigeration unit 18 stops demanding power, then the generator set recognizes the decreased power demand and shuts down.

In an alternative embodiment, the generator controller 54 may be eliminated, or the refrigeration controller 38 may not be able to communicate with the generator controller 54 (e.g., the generator set 42 and refrigeration unit 18 are produced by different manufacturers). In such an embodiment, the refrigeration controller 38 is able to automatically start and stop the generator set 42 without communicating with the generator controller 54. Such an embodiment may include a separate starting and kill device to operate the generator set in both a run mode and a stopped mode.

The invention provides significant fuel savings over currently available generator sets because it operates in a start/stop mode. One way to integrate the start/stop mode is to utilize generator controller 54 software to control power supplied to the refrigeration unit 18.

In the example where the threshold temperature $T_{threshold}$ is the temperature defined between the fresh and frozen ranges, fresh loads generally require tighter temperature control to maintain product quality and are not good candidates for operation in the start/stop mode. Frozen loads are good candidates for operation in the start/stop mode as the temperature control requirements are not as strict. The generator controller 54 can be used to make start and stop control decisions (e.g., blocks 132 and 136) by controller interface between the refrigeration controller 38, the sensor 40, or other components. The controller interface could be established either by direct communications connection (data cable) or by power line communications via modems or other modes and will be based on the difference between container setpoint temperature $T_S$ and actual temperature or measured temperature $T_{measured}$. With above freezing setpoint temperatures $T_S$, the generator set 42 would operate in the continuous mode. With below freezing setpoint temperatures $T_S$, generator set 42 would operate in stop/start mode. In other embodiments, the threshold temperature $T_{threshold}$ may be different. In addition, more than one threshold temperature $T_{threshold}$ may exist.

What is claimed is:

1. A generator set for a container having an air-conditioning unit for controlling the temperature of a space within the container, the generator set comprising:

a prime mover;

a generator coupled to the prime mover; and a controller operating the prime mover in one of a start/stop mode wherein the controller selectively starts and stops operation of the prime mover, and a continuous mode wherein the controller runs the prime mover continuously;

wherein when the controller operates the prime mover in the start/stop mode, the controller automatically starts and stops the prime mover such that the generator produces electricity and is operable to supply the electricity to the air-conditioning unit when the prime mover is operating and the generator does not produce electricity when the prime mover is not operating, the controller being operable to start and stop the prime mover based on a cooling demand.

2. The generator set of claim 1, further comprising a sensor positioned within the temperature controlled space and in communication with the controller;

wherein the controller determines the cooling demand based at least in part on data supplied by the sensor.

3. The generator set of claim 1, wherein the controller operates the prime mover in one of the start/stop mode and the continuous mode based at least in part on a user entered set point temperature indicative of the temperature sensitivity of a product within the temperature controlled space.

4. The generator set of claim 3, wherein the controller operates the prime mover in one of the start/stop mode and the continuous mode based at least in part on a comparison between a threshold value and the user entered set point temperature.

5. The generator set of claim 4, wherein the threshold value defines a temperature between a fresh temperature range and a frozen temperature range.

6. The generator set of claim 1, wherein the generator provides electrical power to the air-conditioning unit; and wherein the controller measures the power provided from the generator to the air-conditioning unit at least in part to determine the cooling demand.

7. The generator set of claim 1, wherein the controller controls the air-conditioning unit.

8. The generator set of claim 1, wherein the generator produces alternating current power.

* * * * *